US007540163B2

(12) United States Patent
Lifson et al.

(10) Patent No.: US 7,540,163 B2
(45) Date of Patent: Jun. 2, 2009

(54) PREVENTION OF FLOODED STARTS IN HEAT PUMPS

(75) Inventors: Alexander Lifson, Manlios, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 495 days.

(21) Appl. No.: 11/059,259

(22) Filed: Feb. 16, 2005

(65) Prior Publication Data

US 2006/0179855 A1 Aug. 17, 2006

(51) Int. Cl.
*F25B 13/00* (2006.01)
*F25B 1/00* (2006.01)
*F25B 19/00* (2006.01)

(52) U.S. Cl. ..... 62/160; 62/115; 62/231

(58) Field of Classification Search ..... 62/160, 62/159, 228.3, 115, 231, 126
See application file for complete search history.

(56) References Cited

U.S. PATENT DOCUMENTS 3,132,490 A 5/1964 Schmidt
3,788,394 A 1/1974 Derragon, Jr.
4,790,142 A * 12/1988 Beckey ..... 62/115
5,632,156 A 5/1997 Takeo et al.

OTHER PUBLICATIONS

International Search Report and Written Opinion dated Aug. 9, 2007.

* cited by examiner

*Primary Examiner*—Chen-Wen Jiang
(74) *Attorney, Agent, or Firm*—Carlson, Gaskey & Olds, P.C.

(57) ABSTRACT

A heat pump is provided with a method and control for eliminating flooded starts. In particular, the heat pump at start-up is operated for a short period of time in the opposite mode to that in which it had been operated before the previous shutdown. In this way, the compressor ingestion of liquid refrigerant is limited or completely eliminated. After a short period of time, the heat pump is moved back to the intended mode of operation. Additional features can be added to the control scheme to limit this type of operation at start-up only to certain ambient conditions or only to a prolonged period between shutdown and start-up.

20 Claims, 1 Drawing Sheet

PREVENTION OF FLOODED STARTS IN HEAT PUMPS

BACKGROUND OF THE INVENTION

This invention relates to a method of operating a heat pump in a reverse mode for a short period of time at start-up to eliminate flooded starts.

Refrigerant systems are utilized to control the temperature and humidity of air in various indoor environments to be conditioned. In a typical refrigerant system operating in the cooling mode, a refrigerant is compressed in a compressor and delivered to a condenser (or outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or indoor heat exchanger). In the evaporator heat is exchanged between the refrigerant and the indoor air, to condition the indoor air. When the refrigerant system is operating, the evaporator cools the air that is being supplied to the indoor environment.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle in order to operate in both heating and cooling modes. This is usually achieved by incorporating a four-way reversing valve or an equivalent device into the system schematic downstream of the compressor discharge port. The four-way reversing valve selectively directs the refrigerant flow through the indoor or outdoor heat exchanger when the system is in the heating or cooling mode of operation respectively. Furthermore, if the expansion device cannot handle the reversed flow, than a pair of expansion devices, each along with a check valve, are employed instead.

A typical problem with the heat pumps is the occurrence of a "flooded start." Since refrigerant migrates to the coldest spot within the system, after system's shutdowns, a significant amount of liquid refrigerant may be accumulated in the evaporator. The evaporator would be the indoor heat exchanger in the cooling mode, and the outdoor heat exchanger in the heating mode. When the system is again started, this liquid refrigerant is ingested into the compressor, which is undesirable for several reasons the most important of which are related to permanent damage of compressor elements, subsequent potential refrigerant circuit contamination and prolonged period of downtime. The flooded start also results in on objectionable noise on compressor start-up.

One method to address flooded starts is the provision to install an accumulator attached to the compressor suction line. However, accumulators would only partly solve the problem since they would only store a limited amount of refrigerant. Accumulators also carry additional system expense and would often be a source of potential refrigerant leaks. Thus, a simpler, less expensive and more reliable solution to eliminate flooded starts would be desirable.

SUMMARY OF THE INVENTION

In a disclosed embodiment of this invention, a heat pump is operated in a reverse mode, from the mode it was before shutdown, for a short period of time. The heat pump is then operated in the original mode to condition the indoor environment. As an example, if the heat pump had been operating in a cooling mode before the last shutdown, the liquid refrigerant would tend to migrate back to the indoor heat exchanger. In accordance with this invention, the system controls would begin to operate the heat pump in a heating mode for a short period of time at the next start-up in order to prevent flooding at the compressor inlet, if certain conditions are satisfied. In this manner, there is no liquid refrigerant to be ingested by the compressor, since the compressor suction at start-up is connected to the outdoor coil (condenser in the cooling mode) and not to the indoor coil (evaporator for the cooling mode). As discussed before, the evaporator is the heat exchanger that may contain liquid at start-up, and not the condenser. During this short operation at start-up the liquid refrigerant in the indoor heat exchanger would have to pass downstream to the expansion device and then flash in the outdoor heat exchanger partially turning into vapor, and then this vapor, after passing through this outdoor heat exchanger, would enter the compressor suction.

After the expiration of a short period of time, the heat pump is switched back to a cooling mode, but by this time the flooded start concern has been eliminated, as the entire liquid refrigerant would have left the indoor heat exchanger.

The reverse would occur if the heat pump had been operating in a heating mode before the last shutdown.

These and other features of the present invention can be best understood from the following specification and drawings, the following of which is a brief description.

DETAILED DESCRIPTION OF THE PREFERRED EMBODIMENT

Figure 1A:
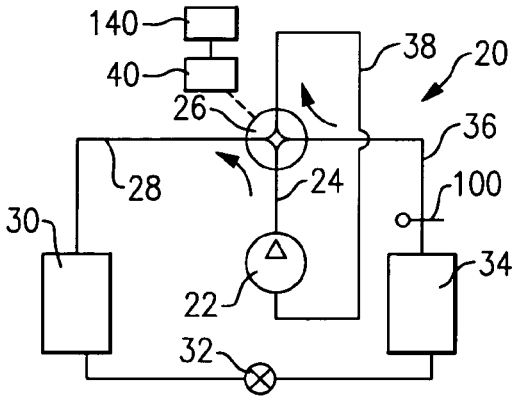
FIG. 1A shows a heat pump, as it would normally operate in a cooling mode.

FIG. 1A shows a heat pump 20 operating in a cooling mode. As known, compressor 22 delivers a compressed refrigerant into a discharge line 24 leading to a four-way reversing valve 26.

Figure 1B:
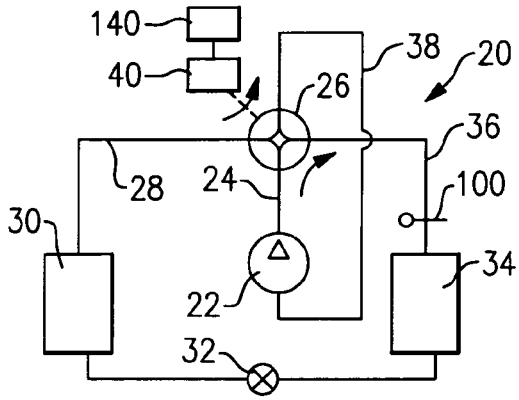
FIG. 1B shows a short-term operation at start-up for the heat pump operating in a cooling mode.

In the cooling mode, the refrigerant passes through the four-way reversing valve 26 from the discharge line 24 to a line 28 leading to an outdoor heat exchanger 30. From the outdoor heat exchanger 30, the refrigerant passes through an expansion device 32, and to an indoor heat exchanger 34. A line 36 is positioned downstream of the indoor heat exchanger 34, and passes refrigerant once again through the four-way reversing valve 26 and then to a suction line 38 returning it to the compressor 22. A control 40 controls the position of the four-way reversing valve 26. It should be noted that although FIG. 1A exhibits the fundamental heat pump concept, incorporation of additional components (e.g. crankcase heaters, accumulator, receiver, check valves, etc.) into the design schematic as well as various configuration modifications are within the scope of the present invention to further alleviate or minimize potential problems with the flooded start As mentioned above, the present invention eliminates flooded start conditions by operating the heat pump 20 at start-up for a short period of time in the reverse mode, or in this case in a heating mode, if certain predetermined conditions are satisfied. Thus, as shown in FIG. 1B, the refrigerant passes from the discharge line 24 through the four-way reversing valve 26 to the line 36, and to the indoor heat exchanger 34. The refrigerant returns through the line 28 and once again through the four-way reversing valve 26 to the suction line 38. After a short period of time, the control 40 reverses the four-way reversing valve 26 back to the FIG. 1A position. However, by this time, the problem associated with a flooded start has been eliminated.

Figure 2A:
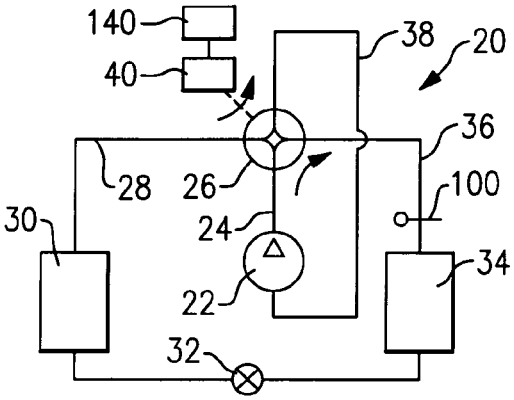
FIG. 2A shows a heat pump operating in a heating mode.
Figure 2B:
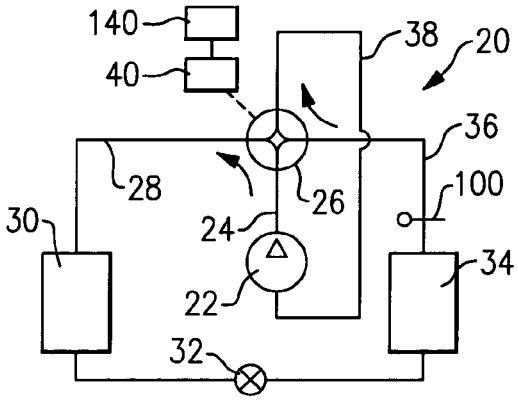
FIG. 2B shows a short-term operation at start-up for the heat pump operating in a heating mode.

FIG. 2A shows the heat pump 20 operating in heating mode. When the heat pump 20 is to be started in heating mode, it will initially be run for a short period of time in the cooling mode, such as shown in FIG. 2B. Again, this will eliminate the problem of flooded starts.

The switch between the modes can be performed on the fly. That is, the valve 26 can be reversed without stopping the compressor and other system components. Alternatively, the switch can be performed after stopping the compressor, and allowing for a brief period of time to pass for pressure equalization across the various components, and in particular the four-way reversing valve 26.

Figure 3:
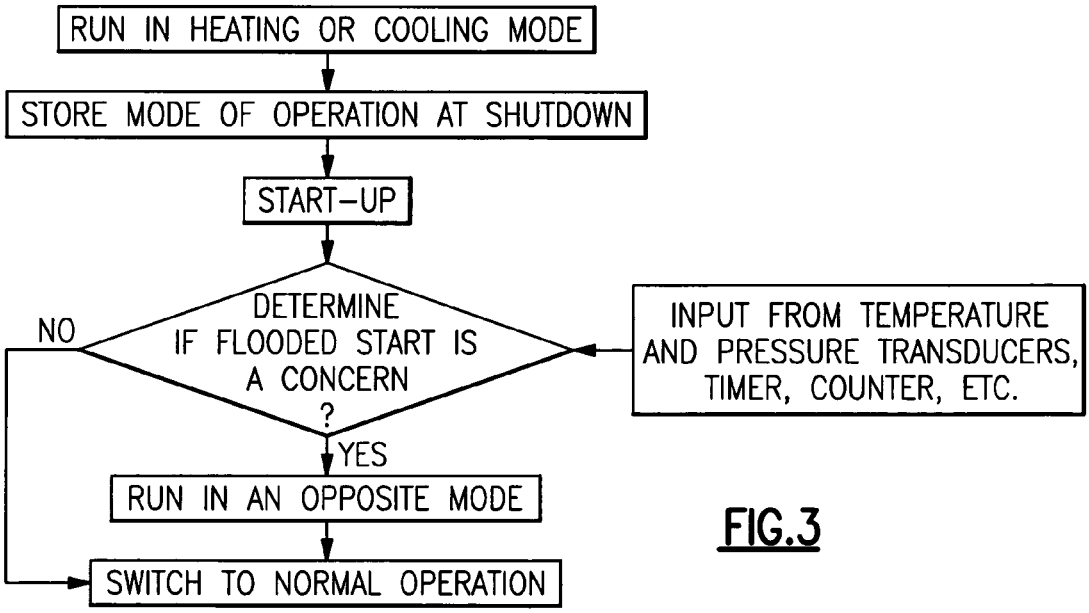
FIG. 3 is a flow chart of the present invention.

FIG. 3 is a brief flow chart of the present invention. The heat pump 20 is run in either a heating or cooling mode. At shutdown, the control 40 remembers the prior state. At start-up, the control 40 moves the four-way reversing valve 26 such that initially the heat pump 20 is run in the reverse mode. After the expiration of a short period of time, the four-way reversing valve 26 is switched back to the desired state to condition the indoor environment.

Further, as shown in FIG. 3, a determination may be made whether flooded starts are likely, and whether this method should be executed on any particular start-up. As an example, various considerations may include but not limited to the amount of time the system has been shut down, ambient temperature conditions, pressures and/or temperatures recorded at various locations inside the unit prior to start-up, and/or the number of starts when the reverse running needed to be made. Of course, a worker of ordinary skill in the art could recognize when to utilize the method of this invention based upon these various sensed parameters. A transducer 100 is shown schematically in these figures and may sense ambient temperature, temperatures and/or pressures at various locations within the unit, etc. Also, the control is shown schematically including a timer and a counter 140.

An example of the necessary "short period of time" is less than two minutes, and may be on the order of 30 seconds. A worker of ordinary skill in the art would recognize how to determine an appropriate period of time for a particular heat pump, and that period of time should be selected to be sufficient to prevent a flooded start.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat pump comprising:

a compressor, said compressor delivering refrigerant to a discharge line, and receiving refrigerant from a suction line, said discharge line and said suction line communicating with a reversing valve, said reversing valve being movable between a heating position and a cooling position, said reversing valve directing refrigerant between an indoor heat exchanger and an outdoor heat exchanger in opposite flow directions in said heating position and in said cooling position, and a control for said reversing valve, said control being programmed to move said reversing valve to an opposite position relative to an intended position at start-up for a period of time then move said reversing valve to said intended position; and said period of time is selected to be sufficient to ensure that there will not be a flooded start at start-up in the intended mode.

2. The heat pump as set forth in claim 1, wherein said intended mode is a cooling mode, and said opposite position is a heating mode.

3. The heat pump as set forth in claim 1, wherein said intended mode is a heating mode, and said opposite position is a cooling mode.

4. The heat pump as set forth in claim 1, wherein said reversing valve is a four-way reversing valve.

5. The heat pump as set forth in claim 1, wherein said control stores a last mode of operation of said heat pump, and moves said reversing valve to a different position, as said opposite position at start-up.

6. The heat pump as set forth in claim 1, wherein said period of time is less than 2 minutes.

7. The heat pump as set forth in claim 1, wherein a timer records the amount of time since a prior start-up, and utilizes said amount of time to determine whether operation at the opposite position is indicated.

8. A heat pump comprising:

a compressor, said compressor delivering refrigerant to a discharge line, and receiving refrigerant from a suction line, said discharge line and said suction line communicating with a reversing valve, said reversing valve being movable between a heating position and a cooling position, said reversing valve directing refrigerant between an indoor heat exchanger and an outdoor heat exchanger in opposite flow directions in said heating position and in said cooling position, and a control for said reversing valve, said control being programmed to move said reversing valve to an opposite position relative to an intended position at start-up for a period of time then move said reversing valve to said intended position; and wherein transducers sense conditions to determine whether operation in the opposite mode is desired based upon a likelihood of a flooded start.

9. The heat pump as set forth in claim 8, wherein said transducer senses ambient conditions to determine whether operation in the opposite mode is desired.

10. The heat pump as set forth in claim 8, wherein said sensed conditions include at least one of temperature and pressure of a refrigerant circulating within said heat pump.

11. The heat pump as set forth in claim 8, wherein said period of time is selected to be sufficient to ensure that there will not be a flooded start at start-up in the intended mode.

12. A method of operating a heat pump comprising the steps of:

(1) operating said heat pump in one of a cooling and heating mode;

(2) shutting down said heat pump;

(3) starting said heat pump back up to run in said one of said cooling and heating modes, by initially moving said heat pump to operate in the other of said cooling and heating modes; and (4) switching said heat pump to said one of said cooling and heating modes after running in said other of said cooling and heating states for a period of time.

13. The method as set forth in claim 12, wherein a control for performing step (4) stores said one of said cooling and heating modes at shutdown.

14. The method as set forth in claim 12, wherein said period of time is less than five minutes.

15. The method as set forth in claim 12, including the steps of determining whether initially moving the heat pump to operate in the other of said cooling and heating modes is necessary based upon sensed system conditions.

16. The method as set forth in claim 15, wherein said sensed system conditions include ambient conditions.

17. The method as set forth in claim 15, wherein sensed system conditions include conditions internal to said heat pump.

18. The method as set forth in claim 17, wherein said sensed system conditions include sensing at least one of temperature and pressure of a refrigerant circulating within said heat pump.

19. The method as set forth in claim 12, wherein the desirability of initially moving said heat pump to operate in the other of said cooling and heating modes is determined based at least in part upon a period of time since the system was previously shut down.

20. The method as set forth in claim 12, wherein said period of time is selected to be sufficient to eliminate the possibility of a flooded start.

* * * * *

UNITED STATES PATENT AND TRADEMARK OFFICE

CERTIFICATE OF CORRECTION

PATENT NO. : 7,540,163 B2
APPLICATION NO. : 11/059259
DATED : June 2, 2009
INVENTOR(S) : Lifson et al.

It is certified that error appears in the above-identified patent and that said Letters Patent is hereby corrected as shown below:

Title Page item 75

INVENTORS:

Change the city for inventor Alexander Lifson from "Manlios, NY" to "Manlius, NY"

Signed and Sealed this

Twenty-fifth Day of August, 2009

David J. Kappos

David J. Kappos
*Director of the United States Patent and Trademark Office*